US006378846B1

(12) United States Patent
Terakado et al.

(10) Patent No.: US 6,378,846 B1
(45) Date of Patent: Apr. 30, 2002

(54) CARBURETOR WITH ADJUSTABLE FLOW RATE THROTTLE LEVER

(75) Inventors: Hitoshi Terakado; Shinichi Ohgane; Teruhiko Tobinai, all of Miyagi (JP)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/591,876

(22) Filed: Jun. 12, 2000

(30) Foreign Application Priority Data

Jun. 24, 1999 (JP) ..... 11-178911

(51) Int. Cl.[7] ..... F02M 9/08
(52) U.S. Cl. ..... 261/44.8
(58) Field of Search ..... 261/44.3, 44.4, 261/44.6, 44.7, 44.8, 64.1, 64.4, 65

(56) References Cited

U.S. PATENT DOCUMENTS

| | | | | |
|---|---|---|---|---|
| 4,481,152 A | * | 11/1984 | Kobayashi et al. | 261/44.8 X |
| 4,481,153 A | * | 11/1984 | Kobayashi et al. | 261/44.8 X |
| 5,599,484 A | * | 2/1997 | Tobinai | 261/44.8 X |
| 5,709,822 A | * | 1/1998 | Togashi | 261/44.8 X |
| 5,942,160 A | * | 8/1999 | Araki | 261/44.8 |

FOREIGN PATENT DOCUMENTS

| | | |
|---|---|---|
| DE | 1963513 | 2/1998 |
| JP | 59215932 | 12/1984 |
| JP | 08177532 | 7/1996 |
| JP | 11044257 | 2/1999 |
| JP | 11210504 | 8/1999 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A throttle valve lever for controlling the rate of fuel flow in a rotary throttle valve type carburetor is proposed, wherein the throttle valve lever has increased stiffness to help prevent structural deformation due to excessive force exerted and applied to the lever over time. The throttle valve lever basically includes an oblong structure comprising synthetic resin and an oblong reinforcement plate comprising metal. The resin structure has a hole defined therethrough, which is capable of fitting around the shaft of a throttle valve of a carburetor, and also has a lever portion at one end of the resin structure. The metal plate has a hole defined therethrough, which is capable of fitting around the shaft of a throttle valve of a carburetor, and also has a lever portion at one end of the metal plate. The metal plate is embedded within the resin structure such that the lever portion of the resin structure and the lever portion of the metal plate are correspondingly situated, the hole of the resin structure and the hole of the metal plate are aligned, and the metal plate is exposed at the metal plate hole and is capable of direct and fitted contact with the throttle valve shaft.

24 Claims, 2 Drawing Sheets

CARBURETOR WITH ADJUSTABLE FLOW RATE THROTTLE LEVER

REFERENCE TO RELATED APPLICATION

Applicants claim the priority of Japanese patent application, Ser. No, 11-178911, filed Jun. 24, 1999.

FIELD OF THE INVENTION

The present invention relates to a carburetor for an engine and, more particularly, to a throttle valve lever capable of controlling the rate of fuel flow in a rotary throttle valve type carburetor.

BACKGROUND OF THE INVENTION

For a throttle valve lever capable of controlling the rate of fuel flow in a rotary throttle valve type carburetor, a problem concerning the structural integrity of the lever often arises as the lever is utilized over time. For example, a carburetor of a rotary throttle valve type is disclosed in JP Patent Application Number 9-215679 and has a throttle valve and a throttle valve lever molded of synthetic resin. Although the sliding portions of such a carburetor exhibit excellent operational smoothness, the carburetor has the distinct drawback of being unable to reliably control the amount of fuel and the rate of fuel flow therethrough. In particular, when excessive force is exerted upon the throttle valve lever of the carburetor over time, such force often eventually causes structural deformation of the throttle valve lever and/or structural looseness and rattle at the joint between the throttle valve lever and the shaft portion of the throttle valve. As a result, undesired variation in the amount of fuel and the rate of fuel flow for engine operation typically occurs as the throttle valve lever and throttle valve are subsequently manipulated and moved into their many operative positions. In light of such, the prospect of utilizing such a carburetor often produces fear and concern among manufacturers that strict exhaust gas regulations cannot be properly observed and conformed to if such a carburetor is incorporated within a particular engine design.

In view of the above, there is a present need in the art for a throttle valve lever or a throttle valve lever assembly which maintains its structural integrity when utilized over time. More particularly, there is a present need in the art for a throttle valve lever or a throttle valve lever assembly which is resistant to both structural deformation of the throttle valve lever and looseness and rattle at the joint between the throttle valve lever and the shaft portion of the throttle valve when utilized over time.

SUMMARY OF THE INVENTION

The present invention provides a throttle valve lever for controlling the rate of fuel flow in a rotary throttle valve type carburetor. The throttle valve lever has increased stiffness to help prevent structural deformation due to excessive force exerted and applied to the lever over time. According to the present invention, the throttle valve lever basically includes an oblong structure comprising synthetic resin and an oblong reinforcement plate comprising metal. The resin structure has a hole defined therethrough, which is capable of fitting around the shaft of a throttle valve of a carburetor, and also has a lever portion at one end of the resin structure. Similarly, the metal plate has a hole defined therethrough, which is capable of fitting around the shaft of a throttle valve of a carburetor, and also has a lever portion at one end of the metal plate. The metal plate is embedded within the resin structure such that the lever portion of the resin structure and the lever portion of the metal plate are correspondingly situated, the hole of the resin structure and the hole of the metal plate are aligned, and the metal plate is exposed at the metal plate hole and is capable of direct and fitted contact with the throttle valve shaft.

The incorporation of the metal plate within the lever serves to increase the overall stiffness of the lever and thereby helps fortify the structural integrity of the lever and prevent structural deformation. Furthermore, exposure of the metal plate at the metal plate hole enables the lever to be mounted on the shaft of a throttle valve at the metal plate hole such that the metal plate itself is in direct and fitted contact with the throttle valve shaft. In this way, the structural integrity of a throttle valve lever assembly is also fortified such that looseness and rattle at a joint between the throttle valve lever and the shaft of the throttle valve is thereby largely prevented.

In a preferred embodiment of the throttle valve lever, the metal plate is embedded within the resin structure by insert molding. The metal plate also preferably has a plurality of throughholes which are defined through the metal plate. The throughholes enable the metal plate to be embedded within the resin structure such that the resin structure covers and fills the metal plate throughholes to thereby enhance the overall structural integrity of the throttle valve lever.

Also in a preferred embodiment of the throttle valve lever, the hole in the metal plate is smaller than the hole in the resin structure. The metal plate hole preferably defines a first surface and a second surface within the metal plate such that both the first surface and the second surface are substantially flat. The first surface and the second surface of the metal plate hole preferably have different lengths and are situated substantially parallel with each other. In this way, the shaft of a throttle valve can be precisely fitted into the metal plate hole in only one particular orientation. As a result, improper mounting of the throttle valve lever onto the shaft of the throttle valve as well as looseness and rattle at the joint between the throttle valve lever and the throttle valve shaft are thereby prevented.

Further in a preferred embodiment of the throttle valve lever, the resin structure, in addition to having a lever portion at one end, also has a cam portion at another end of the resin structure which is remote from the lever portion of the resin structure. Similarly, the metal plate, in addition to having a lever portion at one end, also preferably has a cam portion at another end of the metal plate which is remote from the lever portion of the metal plate. The metal plate is preferably embedded within the resin structure such that the resin structure cam portion and the metal plate cam portion are correspondingly situated and such that the resin structure cam portion and the metal plate cam portion cooperatively define an engageable cam surface. The cam surface preferably defines a groove of graduated depth which extends arcuately along the perimeters of the resin structure cam portion and the metal plate cam portion on the underside of the throttle valve lever. In one particular preferred embodiment, the metal plate is covered by the resin structure within the groove such that the resin structure is directly engageable by a cam follower within the groove. In another particular preferred embodiment, the metal plate is exposed within the groove such that the metal plate is directly engageable by a cam follower within the groove. Such a cam surface and groove are, for example, suitable for a cold-start fuel increasing mechanism for an engine.

Lastly in a preferred embodiment of the throttle valve lever, the resin structure also has a swivel throughhole defined through the resin structure lever portion, and the metal plate also has a swivel throughhole defined through the metal plate lever portion. The metal plate is preferably embedded within the resin structure such that the swivel throughhole of the resin structure and the swivel throughhole of the metal plate are aligned with each other and engageable with a swivel. Preferably, the swivel throughhole of the resin structure is smaller than the swivel throughhole of the metal plate.

In addition to a throttle valve lever, the present invention also provides a throttle valve lever assembly. According to the present invention, the throttle valve lever assembly basically includes a rotary throttle valve with a shaft portion, an oblong structure comprising synthetic resin, and an oblong reinforcement plate comprising metal. The resin structure has a hole defined therethrough, within which the shaft portion of the throttle valve is fitted, and also has a lever portion at one end of the resin structure. Similarly, the metal plate has a hole defined therethrough, within which the shaft portion of the throttle valve is fitted, and also has a lever portion at one end of the metal plate. The metal plate is embedded within the resin structure such that the lever portion of the resin structure and the lever portion of the metal plate are correspondingly situated, the hole of the resin structure and the hole of the metal plate are aligned, and the metal plate is in direct and fitted contact with the throttle valve shaft portion.

As in the case of the above-mentioned throttle valve lever, the incorporation of the metal plate within the throttle valve lever assembly serves to increase the overall stiffness of the assembly and thereby helps fortify the structural integrity of the assembly and prevent structural deformation. Furthermore, since the metal plate is in direct and fitted contact with the throttle valve shaft portion at the metal plate hole, the structural integrity of the throttle valve lever assembly is further fortified because looseness and rattle at the joint between the throttle valve lever and the shaft of the throttle valve are thereby largely prevented.

In a preferred embodiment of the throttle valve lever assembly, the hole in the metal plate is smaller than the hole in the resin structure. The throttle valve has an axial throughhole through the length of the throttle valve such that the shaft portion of the throttle valve has a hollow tip end. Preferably, the hollow tip end is fitted through the metal plate hole, bent radially outward, and tightly crimped onto the metal plate. In this way, looseness and rattle at the joint between the throttle valve lever and the shaft of the throttle valve are thereby largely prevented. Furthermore, the hole in the metal plate preferably defines a first surface and a second surface within the metal plate such that both the first surface and the second surface are substantially flat. The first surface and the second surface of the metal plate hole preferably have different lengths and are situated substantially parallel with each other. The hollow tip end of the throttle valve shaft portion preferably has a cross-section which corresponds to the shape of the metal plate hole so that the hollow tip end precisely fits the metal plate hole in only one particular orientation. As a result, improper mounting of the throttle valve lever onto the shaft of the throttle valve as well as looseness and rattle at the joint between the throttle valve lever and the throttle valve shaft are thereby prevented.

Objects, features, and advantages of the present invention include providing a throttle valve lever and throttle valve lever assembly which are resistant to structural deformation, resistant to loosening and rattling, and which are compact, rugged, durable, of relatively simple design and economical manufacture and assembly, and which in service have a long useful life.

BRIEF DESCRIPTION OF THE DRAWINGS

These and other objects, features, and advantages of this invention will be apparent from the following detailed description of the preferred embodiment and best mode, appended claims, and accompanying drawings in which:

DETAILED DESCRIPTION OF THE PREFERRED EMBODIMENT

Structure of the Preferred Embodiment

Figure 1:
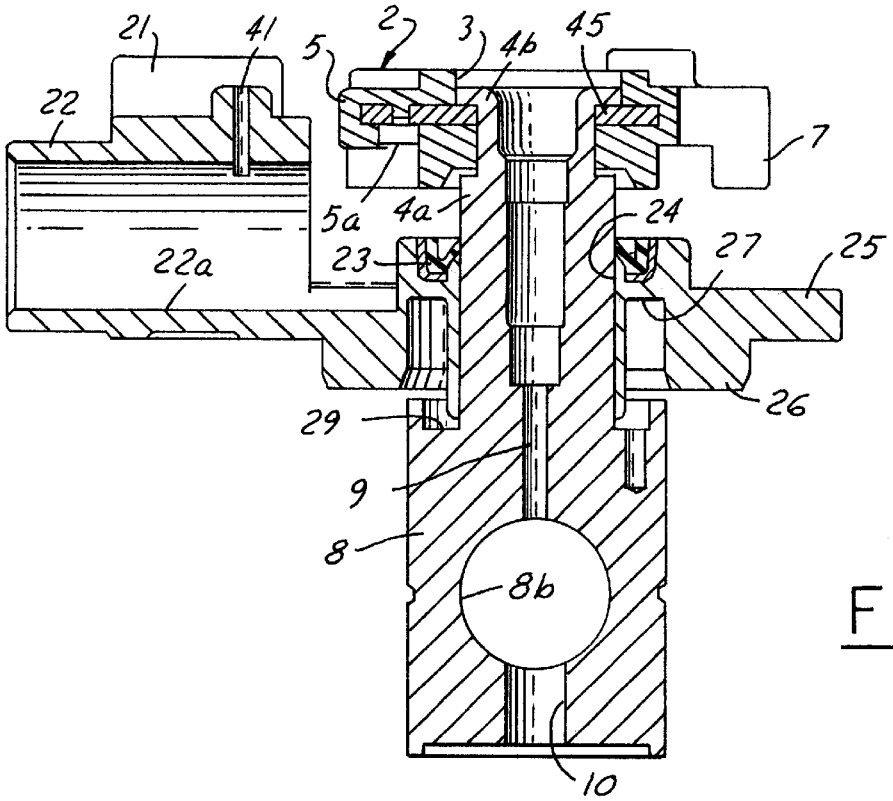
FIG. 1 is a side and sectional view illustrating, according to the present invention, a throttle valve lever for controlling the rate of fuel flow in a rotary throttle valve type carburetor, wherein the throttle valve lever is fitted and joined to the shaft portion of a throttle valve, and the shaft portion is movably fitted in the shaft hole of a lid which closes the upper end of a hollow carburetor body (not shown)

FIG. 1 is a side and sectional view illustrating, according to the present invention, the positional relationship between a lid 25 which closes the upper end opening of a carburetor body (not shown) of a rotary throttle valve type carburetor and a throttle valve lever 2 joined to the upper end of a throttle valve 8. The underside of the lid 25 is provided with a cylindrical projection 26 which fits in the upper end opening of the carburetor body. The throttle valve 8 comprises synthetic resin and has a shaft portion 4*a* which is rotatably and vertically movably fitted in a shaft hole 24 provided at the center of the cylindrical projection 26 of the lid 25. The non-shaft portion of the throttle valve 8 is rotatably and vertically movably fitted in a cylindrical valve chamber (not shown) defined within the carburetor body and crosses a suction path or air and fuel mixing passage of the carburetor body. A seal member 23 is mounted at the upper end of the shaft hole 24 of the lid 25 to prevent dust particles and the like from becoming interposed between the shaft portion 4*a* of the throttle valve 8 and the lid 25, thereby ultimately preventing such particles from entering the valve chamber within the carburetor body. The underside of the lid 25 is formed with an annular groove 27 which surrounds the shaft hole 24 of the lid 25. Correspondingly, an annular groove 29 is also formed in the upper end of the throttle valve 8. The alignment of the annular groove 27 of the lid 25 with the annular groove 29 of the throttle valve 8 enables a coil spring (not shown) to be interposed therebetween. In particular, the coil spring can be locked at one end to the lid 25 and also locked at the other end to the throttle valve 8. In this way, the coil spring thereby urges the throttle valve 8 rotatably downward to an idle position.

The throttle valve 8 is provided with a throttle hole 8*b* which is capable of full communication with the suction path or air and fuel mixing passage of the carburetor body when the throttle valve 8 is in a fully open position. An axial throughhole 10 extends downward through the throttle valve from the throttle hole 8*b*. In this way, a fuel nozzle (not shown) can be extended into the throttle hole 8*b* from a constant pressure fuel chamber (not shown) located at the bottom of the carburetor body via the throughhole 10. An axial throughhole 9 is also provided which extends upward from the throttle hole 8*b*. In this way, a needle valve (not shown) can be threaded and supported in the throughhole 9 such that the needle valve is fitted and projects into the above-mentioned fuel nozzle to thereby control the opening of a fuel injection hole (not shown).

Figure 3:
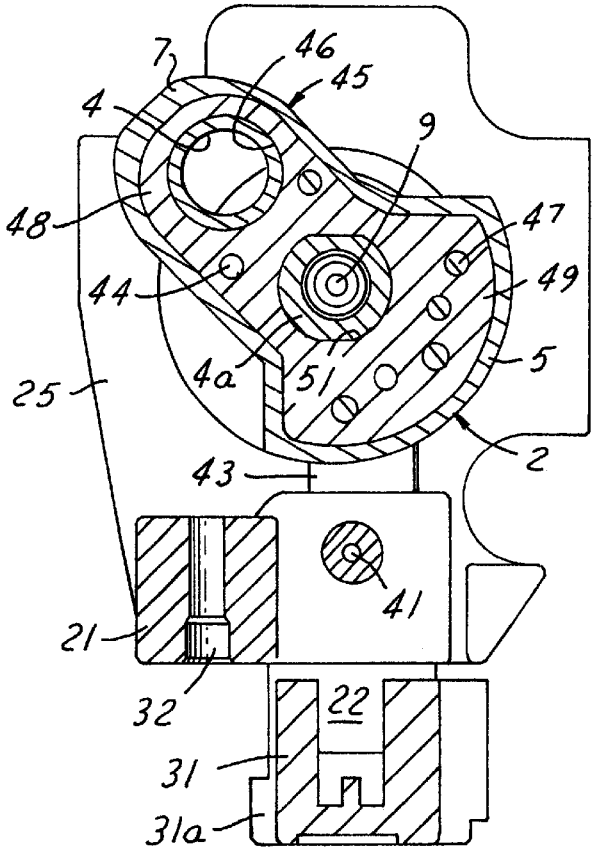
FIG. 3 is a plan and sectional view illustrating, according to the present invention, the throttle valve lever and the lid.
Figure 4:
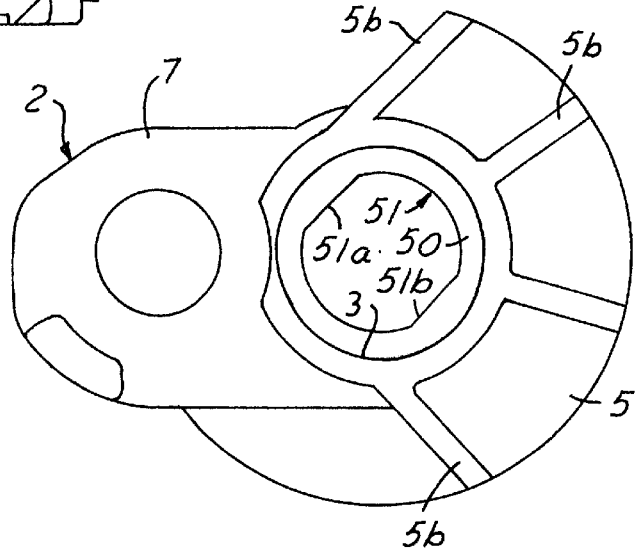
FIG. 4 is a plan view illustrating, according to the present invention, the throttle valve lever.

As illustrated in FIG. 1 and in FIG. 3, according to the present invention, the shaft portion 4*a* of the throttle valve 8 of synthetic resin is fitted in an oblong reinforcement metal plate 45 which is embedded in the oblong synthetic resin outer structure of the throttle valve lever 2 by insert molding. More particularly, the shaft portion 4*a* of the throttle valve 8 has a tip end 4*b* which is hollow and has its rim bent radially outward and tightly crimped on the reinforcement metal plate 45. As particularly illustrated in FIG. 3, the tip end 4*b* of the shaft portion 4*a* of the throttle valve 8 has a cross-section with a pair of substantially flat and substantially parallel surfaces having different lengths. As particularly illustrated in FIG. 3 and in FIG. 4, the reinforcement metal plate 45 is also provided, in correspondence to the cross-section of the shaft portion 4*a* of the throttle valve 8, with a shaft hole 51 having a pair of substantially flat and substantially parallel surfaces 51*a* and 51*b* having different lengths. With such a construction, an improper or erroneous mounting of the throttle valve lever 2 on the shaft portion 4*a* of the throttle valve 8 is prevented. As illustrated in FIG. 3, once the throttle valve lever 2 is properly fitted over the shaft portion 4*a* of the throttle valve 8, the throttle valve lever 2 is always orientated to project to the left when in an idle position.

As illustrated in FIG. 3, the synthetic resin outer structure of the throttle valve lever 2 is integrally provided with a lever portion 7 having a throughhole 4 and also with a dovetail-like cam portion 5. The reinforcement metal plate 45, which is embedded in the synthetic resin outer structure of the throttle valve lever 2 by insert molding, is similarly provided with a lever portion 48 having a throughhole 46 and also with a cam portion 49. The lever portion 48 and the cam portion 49 are remotely located on opposite ends of the reinforcement metal plate 45. Furthermore, in addition to the shaft hole 51 of modified cross-section for fitting the shaft portion 4*a* of the throttle valve 8 therein, the reinforcement metal plate 45 also has many throughholes such as 44 and 47 for ensuring structural integrity with the synthetic resin outer structure. The lever portion 7 and the cam portion 5 of the synthetic resin outer structure are remotely located at opposite ends of the synthetic resin structure as well, but the resin structure is integrally molded to cover the upper and lower surfaces, the circumferential portions, and the throughholes 44 and 47 of the reinforcement metal plate 45. The shaft hole 51 of the reinforcement metal plate 45, however, is purposely smaller than the shaft holes 3 and 3*a* which are formed in the synthetic resin outer structure. In this way, the shaft hole 51 area of the reinforcement metal plate 45 is exposed, and the reinforcement metal plate 45 itself is in direct and fitted contact with the throttle valve shaft portion 4*a*. As a result, the structural integrity of the joint between the throttle valve lever 2 and the shaft portion 4*a* of the throttle valve 8 is fortified such that looseness and rattle at the joint is thereby largely prevented. Furthermore, the throughhole 4 of the synthetic resin outer structure is smaller than the throughhole 46 of the reinforcement metal plate 45 and is therefore located inside the throughhole 46 of the reinforcement metal plate 45. The throughhole 4 of the synthetic resin outer structure and the throughhole 46 of the reinforcement metal plate 45 are aligned with each other and are therefore cooperatively capable of rotatably supporting a known swivel (not shown). An inner cable of remote control wire (not shown) can be fastened to the swivel and passed through a screw hole 32 of a pillar 21, which projects upwardly from the lid 25, into an outer tube fastened via a fixture to the screw hole 32.

Figure 5:
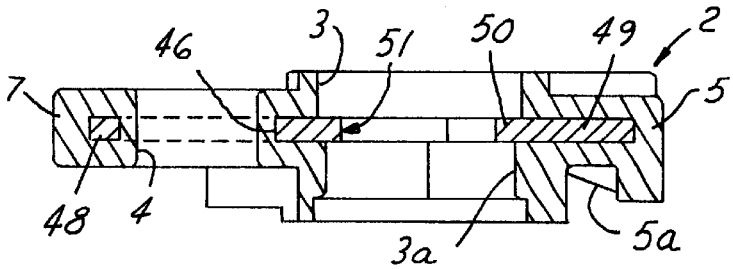
FIG. 5 is a front and sectional view illustrating, according to the present invention, the throttle valve lever.

As illustrated in FIG. 1 and in FIG. 5, a cam groove 5*a* defining a cam surface is formed in the cam portion 5 of the synthetic resin outer structure on the underside of the throttle valve lever 2. The cam groove 5*a* extends arcuately along the perimeters and/or circumferences of the cam portion 5 of the synthetic resin outer structure and the cam portion 49 of the reinforcement metal plate 45. The cam groove 5*a* has a graduated depth which, in the idle position of the throttle valve lever 2 illustrated in FIG. 3, becomes smaller (less deep) from an upper end of the cam portion 5 toward a left lower portion of the cam portion 5. A pin or ball supported on the pillar 21 projecting upward from the lid 25 can be situated to engage the cam groove 5*a*. In this way, a cam mechanism is created wherein the cam surface of the cam groove 5*a* is engageable with a cam follower supported on the lid 25 by the force of the coil spring.

Operation of the Preferred Embodiment

If, from the idle position illustrated in FIG. 3, the throttle valve lever 2 is rotated counterclockwise together with the shaft portion 4*a* of the throttle valve 8, then the throttle valve lever 2 and the throttle valve 8 are pushed upward by the cam mechanism against the action of the above-mentioned coil spring so as to increase the opening of the fuel injection hole of the fuel nozzle and the opening of the throttle hole 8*b* for the suction path of the carburetor body.

Figure 2:
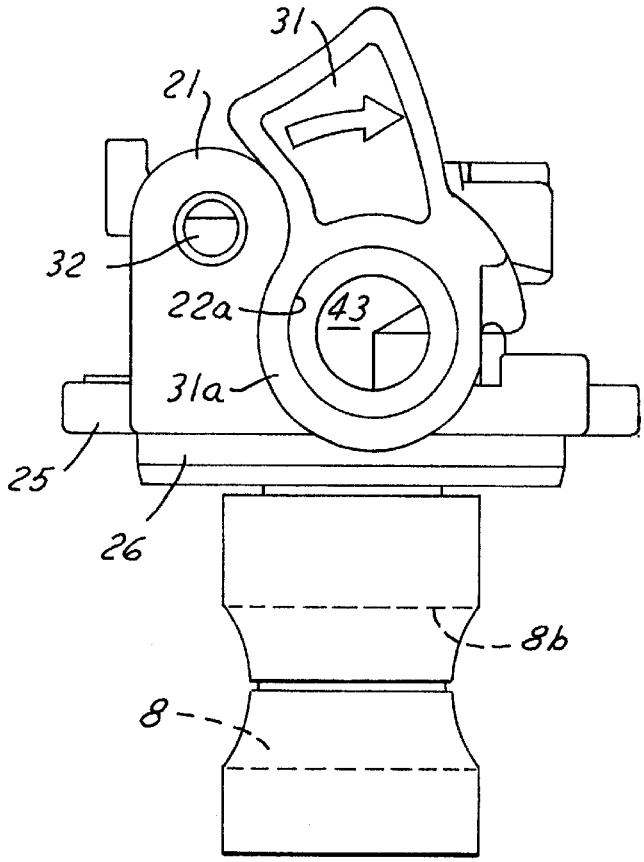
FIG. 2 is a front view illustrating, according to the present invention, the throttle valve lever and the lid with a rotatable cam member.

In the particular embodiment illustrated in the figures, although not indispensable, a starting fuel increasing mechanism is specifically provided in a unit integral with the lid 25 for increasing the amount of fuel delivered at the time of a cold start of an engine. In particular, as illustrated in FIG. 1 and in FIG. 2, a cam member 43 situated and rotatably supported in a cylindrical portion 22*a* of a support member 22 projecting to the left (in FIG. 1) from the lid 25 comes into contact with the underside of the throttle valve lever 2 and pushes the throttle valve lever 2 upward together with the throttle valve 8. A dislocation prevention pin 41 provided in the support member 22 engages an annular groove (not shown) defined in the surface of the cam member 43. As illustrated in FIG. 2, a lever 31 is joined at its boss portion 31 a to an end of the cam member 43. If the lever 31 is rotated by about 60 degrees in the direction of the arrow illustrated in FIG. 2 against the force of the coil spring, the cam surface of the cam member 43 comes into contact with the cam surface of the cam groove 5*a* on the underside of the throttle valve lever 2 and thereby pushes the throttle valve lever 2 upward. If the throttle valve lever 2 is rotated in the direction of its full opening after the engine is started, the cam member 43 disengages from the throttle valve lever 2 so that the cam member 43 is returned to its original position by the force of the coil spring. Such a starting fuel increasing mechanism is disclosed in JP Utility Model Application Number 5-31080 and is incorporated herein in its entirety.

In addition to the particular embodiment illustrated in the figures, it is to be understood that if the cam portion 49 of the reinforcement metal plate 45 is bent corresponding to the graduated depth of the cam groove 5*a* and is also exposed in the cam groove 5*a* such that the pin or ball, as the cam follower supported on the lid 25, is allowed to directly engage the reinforcement metal plate 45 within the cam groove 5*a*, the cam mechanism will realize an improved durability.

In summary, the present invention provides a throttle valve lever 2 for accurately controlling the rate of fuel flow in a rotary throttle valve type carburetor. The throttle valve lever 2 has increased stiffness to help prevent structural deformation due to excessive force exerted and applied to the lever 2 over time. More particularly, the incorporation of the reinforcement metal plate 45 within the lever 2 serves to increase the overall stiffness of the lever 2 and thereby helps fortify the structural integrity of the lever 2 and prevent structural deformation. Furthermore, exposure of the reinforcement metal plate 45 at the metal plate hole 51 (or shaft hole) enables the lever 2 to be mounted on the shaft portion 4*a* of the throttle valve 8 at the metal plate hole 51 such that the reinforcement metal plate 45 itself is in direct and fitted contact with the throttle valve shaft portion 4*a*. In this way, the structural integrity of a throttle valve lever assembly is also fortified such that looseness and rattle at a joint between the throttle valve lever 2 and the shaft 4*a* of the throttle valve 8 is thereby largely prevented.

In addition to the shaft portion 4*a* of the throttle valve 8 being directly fitted in the shaft hole 51 of the reinforcement metal plate 45, the hollow tip end 4*b* of the shaft portion 4*a* of the throttle valve 8 preferably has its rim bent radially outward and is tightly crimped on the upper side of the reinforcement metal plate 45. In this way, a tightly coupled joint between the shaft portion 4*a* of the throttle valve 8 and the throttle valve lever 2 is successfully attained. As a result, accurate control of the amount of fuel and the rate of fuel flow in a rotary throttle valve type carburetor with the throttle valve lever assembly according to the present invention is realized. Furthermore, since the tip end 4*b* of the shaft portion 4*a* of the throttle valve 8 has a modified cross-section with two substantially flat and substantially parallel surfaces having different lengths and since the shaft hole 51 of the reinforcement metal plate 45 has a cross-section corresponding to that of the shaft portion 4*a* of the throttle valve 8, an improper or erroneous mounting of the throttle valve lever 2 on the shaft portion 4*a* of the throttle valve 8 can thereby be prevented.

While the present invention has been described in what is presently considered to be the most practical and preferred embodiment and/or implementation, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures as is permitted under the law.

We claim:

1. A throttle valve lever for controlling the rate of fuel flow in a rotary throttle valve carburetor, said throttle valve lever comprising:

an oblong structure comprising synthetic resin having a hole defined therethrough capable of fitting around the shaft of a throttle valve of said carburetor, said resin structure having a lever portion at one end of said resin structure; and an oblong reinforcement plate comprising metal and having a hole defined therethrough capable of fitting around said throttle valve shaft, said metal plate having a lever portion at one end of said metal plate;

wherein said metal plate is embedded within said resin structure such that said resin structure lever portion and said metal plate lever portion are correspondingly situated, said resin structure hole and said metal plate hole are aligned, and said metal plate is exposed at said metal plate hole and is capable of direct and fitted contact with said throttle valve shaft.

2. The throttle valve lever according to claim 1, wherein said metal plate is embedded within said resin structure by insert molding.

3. The throttle valve lever according to claim 1, said metal plate also having a plurality of throughholes defined through said metal plate, wherein said metal plate is embedded within said resin structure such that said resin structure covers and fills said metal plate throughholes to thereby enhance the structural integrity of said throttle valve lever.

4. The throttle valve lever according to claim 1, wherein said metal plate hole is smaller than said resin structure hole.

5. The throttle valve lever according to claim I, wherein said metal plate hole defines a first surface and a second surface within said metal plate such that both said first surface and said second surface are substantially flat, are substantially parallel with each other, and have different lengths.

6. The throttle valve lever according to claim 1, said resin structure also having a cam portion at another end of said resin structure remote from said resin structure lever portion, and said metal plate also having a cam portion at another end of said metal plate remote from said metal plate lever portion;

wherein said metal plate is embedded within said resin structure such that said resin structure cam portion and said metal plate cam portion are correspondingly situated, and said resin structure cam portion and said metal plate cam portion cooperatively define an engageable cam surface.

7. The throttle valve lever according to claim 6, wherein said cam surface defines a groove of graduated depth which extends arcuately along the perimeters of said resin structure cam portion and said metal plate cam portion on the underside of said throttle valve lever.

8. The throttle valve lever according to claim 7, wherein said metal plate is covered by said resin structure within said groove such that said resin structure is directly engageable by a cam follower within said groove.

9. The throttle valve lever according to claim 7, wherein said metal plate is exposed within said groove such that said metal plate is directly engageable by a cam follower within said groove.

10. The throttle valve lever according to claim 1, said resin structure also having a swivel throughhole defined through said resin structure lever portion, and said metal plate also having a swivel throughhole defined through said metal plate lever portion;

wherein said metal plate is embedded within said resin structure such that said resin structure swivel throughhole and said metal plate swivel throughhole are aligned and engageable with a swivel.

11. The throttle valve lever according to claim 10, wherein said resin structure swivel throughhole is smaller than said metal plate swivel throughhole.

12. A throttle valve lever for controlling the rate of fuel flow in a rotary throttle valve carburetor, said throttle valve lever comprising:

an oblong structure comprising synthetic resin having a hole defined therethrough capable of fitting around the shaft of a throttle valve of said carburetor, said resin structure having a lever portion and a cam portion at remote ends of said resin structure; and an oblong reinforcement plate comprising metal and having a hole defined therethrough capable of fitting around said throttle valve shaft, said metal plate having a lever portion and a cam portion at remote ends of said metal plate;

wherein said metal plate is embedded within said resin structure such that said resin structure lever portion and said metal plate lever portion are correspondingly situated, said resin structure cam portion and said metal plate cam portion are correspondingly situated, said resin structure cam portion and said metal plate cam portion cooperatively define an engageable cam surface, said resin structure hole and said metal plate hole are aligned, and said metal plate is exposed at said metal plate hole and is capable of direct and fitted contact with said throttle valve shaft.

13. A throttle valve lever assembly for controlling the rate of fuel flow in a rotary throttle valve carburetor, said throttle valve lever assembly comprising:

a rotary throttle valve having a shaft portion;

an oblong structure comprising synthetic resin having a hole defined therethrough within which said shaft portion of said throttle valve is fitted, said resin structure having a lever portion at one end of said resin structure; and an oblong reinforcement plate comprising metal and having a hole defined therethrough within which said throttle valve shaft portion is fitted, said metal plate having a lever portion at one end of said metal plate;

wherein said metal plate is embedded within said resin structure such that said resin structure lever portion and said metal plate lever portion are correspondingly situated, said resin structure hole and said metal plate hole are aligned, and said metal plate is in direct and fitted contact with said throttle valve shaft portion.

14. The throttle valve lever assembly according to claim 13, said metal plate also having a plurality of throughholes defined through said metal plate, wherein said metal plate is embedded within said resin structure such that said resin structure covers and fills said metal plate throughholes to thereby enhance the structural integrity of said throttle valve lever.

15. The throttle valve lever assembly according to claim 13, said resin structure also having a cam portion at another end of said resin structure remote from said resin structure lever portion, and said metal plate also having a cam portion at another end of said metal plate remote from said metal plate lever portion;

wherein said metal plate is embedded within said resin structure such that said resin structure cam portion and said metal plate cam portion are correspondingly situated, and said resin structure cam portion and said metal plate cam portion cooperatively define an engageable cam surface.

16. The throttle valve lever assembly according to claim 15, wherein said cam surface defines a groove of graduated depth which extends arcuately along the perimeters of said resin structure cam portion and said metal plate cam portion on the underside of said throttle valve lever.

17. The throttle valve lever assembly according to claim 16, wherein said metal plate is covered by said resin structure within said groove such that said resin structure is directly engageable by a cam follower within said groove.

18. The throttle valve lever assembly according to claim 16, wherein said metal plate is exposed within said groove such that said metal plate is directly engageable by a cam follower within said groove.

19. The throttle valve lever assembly according to claim 13, said resin structure also having a swivel throughhole defined through said resin structure lever portion, and said metal plate also having a swivel throughhole defined through said metal plate lever portion;

wherein said metal plate is embedded within said resin structure such that said resin structure swivel throughhole and said metal plate swivel throughhole are aligned and engageable with a swivel.

20. The throttle valve lever assembly according to claim 19, wherein said resin structure swivel throughhole is smaller than said metal plate swivel throughhole.

21. The throttle valve lever assembly according to claim 13, wherein said metal plate hole is smaller than said resin structure hole.

22. The throttle valve lever assembly according to claim 21, said throttle valve having an axial throughhole through the length of said throttle valve such that said throttle valve shaft portion has a hollow tip end, wherein said hollow tip end is fitted through said metal plate hole, bent radially outward, and crimped onto said metal plate.

23. The throttle valve lever assembly according to claim 13, wherein said metal plate hole defines a first surface and a second surface within said metal plate such that both said first surface and said second surface are substantially flat, are substantially parallel with each other, and have different lengths.

24. The throttle valve lever assembly according to claim 23, said throttle valve having an axial throughhole through the length of said throttle valve such that said throttle valve shaft portion has a hollow tip end, wherein said hollow tip end has a cross-section which corresponds to the shape of said metal plate hole so that said hollow tip end precisely fits said metal plate hole.

* * * * *

UNITED STATES PATENT AND TRADEMARK OFFICE

CERTIFICATE OF CORRECTION

PATENT NO. : 6,378,846 B1 
DATED : April 30, 2002
INVENTOR(S) : Hitoshi Terakado, Shinichi Ohgane and Teruhiko Tobinai It is certified that error appears in the above-identified patent and that said Letters Patent is hereby corrected as shown below:

Column 8,
Line 14, delete "claim I" and insert -- claim 1 --.

Signed and Sealed this

Seventeenth Day of September, 2002

*Attest:*

*Attesting Officer*

JAMES E. ROGAN
*Director of the United States Patent and Trademark Office*